US008618993B2

(12) United States Patent
Yun et al.

(10) Patent No.: US 8,618,993 B2
(45) Date of Patent: Dec. 31, 2013

(54) LOOP ANTENNA

(75) Inventors: Je-Hoon Yun, Daejon (KR); Jung-Ick Moon, Daejon (KR); Soon-Soo Oh, Daejon (KR); Min-Sung Kwon, Daejon (KR); Sung-Uk You, Daejon (KR); Chang-Joo Kim, Daejon (KR); Chieteuk Ahn, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 686 days.

(21) Appl. No.: 12/447,256

(22) PCT Filed: Oct. 26, 2007

(86) PCT No.: PCT/KR2007/005331

§ 371 (c)(1),
(2), (4) Date: Aug. 19, 2009

(87) PCT Pub. No.: WO2008/051057

PCT Pub. Date: May 2, 2008

(65) Prior Publication Data

US 2009/0322634 A1 Dec. 31, 2009

(30) Foreign Application Priority Data

Oct. 26, 2006 (KR) ..... 10-2006-0104713

(51) Int. Cl.

| | |
|---|---|
| ***H01Q 11/12*** | (2006.01) |
| ***H01Q 7/00*** | (2006.01) |
| ***H01Q 1/38*** | (2006.01) |
| ***H01Q 5/00*** | (2006.01) |

(52) U.S. Cl.
USPC ..... 343/741; 343/866; 343/700 MS

(58) Field of Classification Search
USPC ..... 343/741, 866, 700 MS
See application file for complete search history.

(56) References Cited

U.S. PATENT DOCUMENTS

| | | | | |
|---|---|---|---|---|
| 5,485,165 | A | 1/1996 | Foard | |
| 5,751,255 | A | 5/1998 | Carter, Jr. | |
| 5,936,594 | A | 8/1999 | Yu et al. | |
| 6,891,508 | B2 | 5/2005 | Inoue | |
| 7,253,771 | B2 * | 8/2007 | Maniwa et al. | 343/700 MS |
| 7,408,524 | B2 * | 8/2008 | Ogino | 343/866 |

(Continued)

FOREIGN PATENT DOCUMENTS

| | | |
|---|---|---|
| JP | 2000-183631 | 6/2000 |
| JP | 2002-271128 | 9/2002 |
| KR | 10-2003-0008902 A | 1/2003 |
| KR | 10-2004-0100057 A | 12/2004 |

(Continued)

OTHER PUBLICATIONS

T. Tsukiji et al., "Double-Folded Monopole Antenna Using Parallel Line or Coaxial Cable," IEE Proc.-Microw. Antennas Propag., vol. 149, no. 1, pp. 17-22, Feb. 2002.

*Primary Examiner* — Douglas W Owens
*Assistant Examiner* — Jennifer F Hu
(74) *Attorney, Agent, or Firm* — Rabin & Berdo, P.C.

(57) ABSTRACT

Provided is a loop antenna. The loop antenna includes a first antenna element embodied as a coaxial cable, a second antenna element embodied as a line and connected to one end of the first antenna element in series, a third antenna eLement embodied as a line, having one end connected to a ground plane and the other end connected to the other end of the first antenna element in series, and a power feeding cable for supplying power to the second antenna element.

11 Claims, 12 Drawing Sheets

(56) References Cited

U.S. PATENT DOCUMENTS

| | | | | |
|---|---|---|---|---|
| 2002/0024472 | A1* | 2/2002 | Thursby et al. | 343/741 |
| 2005/0040991 | A1* | 2/2005 | Crystal | 343/747 |
| 2008/0036667 | A1* | 2/2008 | Fedan | 343/741 |

FOREIGN PATENT DOCUMENTS

| | | | |
|---|---|---|---|
| KR | 10-2005-0108879 | A | 11/2005 |
| KR | 10-0648834 | | 11/2006 |

* cited by examiner

LOOP ANTENNA

TECHNICAL FIELD

The present invention relates to a loop antenna; and, more particularly, to a loop antenna including a coaxial cable installed at a predetermined section of an antenna element, capable of controlling a resonant frequency without changing an overall length of an antenna element, having high antenna efficiency, and having a small size.

This work was supported by the IT R&D program of MIC/IITA ["Development of Antenna Measurement System Technology"].

BACKGROUND ART

Lately, voice, video, and broadcasting services have been provided to users using ultrahigh frequency (UHF), such as a digital television (DTV) service, a terrestrial digital multimedia broadcasting (T-DMB) service, a digital video broadcasting-handheld (DVB-H) service, a satellite digital multimedia broadcasting (S-DMB) service, and a digital audio broadcasting (DAB) service. The wavelength of a usable frequency bandwidth of the services is greater than the size of a mobile phone.

In order to receive such services, an antenna needs to have a bigger size which may be bigger than the mobile phone. Such a bigger antenna makes a user feel inconvenience in using the mobile phone and it is difficult to design the mobile phone to internally include such an antenna.

Since it is necessary to design a mobile terminal in consideration of mobility and portability as well as a multimedia function, various technologies have been introduced for internally installing an antenna in a case of a mobile terminal. An internal antenna has been widely used for cellular mobile communication, PCS mobile communication, wireless local area network (W-LAN) because a wavelength of a usable frequency bandwidth thereof is shorter than a case of a terminal. However, it is impossible to use the internal antenna if the wavelength of a usable frequency is greater than a case of a terminal, for example, DVB-H or T-DMB.

A mobile phone antenna is generally classified into a monopole antenna and a non-monopole antenna.

The monopole antenna is an antenna inducing resonance by reducing the size of an antenna from a ½ wavelength to a ¼ wavelength using an image effect of a ground plane. For example, a whip antenna, a helical antenna, a sleeve antenna, and an N-shaped antenna are the monopole antenna. Most of the monopole antennas are an external antenna and has a ¼ wavelength.

In case of a monopole antenna, the size thereof was reduced by installing a disk shaped top loaded at an end of an antenna element, twisting an antenna element in a meander shape, or rolling up an antenna element like a helical antenna. However, it was difficult to maintain the size of an antenna smaller than a 1/10 wavelength while maintaining high antenna efficiency.

Also, a disk shaped monopole antenna having an inductance element such as a helical antenna was introduced to reduce the size thereof. Although the disk shaped monopole antenna has a wideband characteristic, the disk shaped monopole antenna has a complicated structure, a high height, and a wide width. Thus, it was difficult to internally install the disk shaped monopole antenna in a case of a terminal.

As an non-monopole antenna, an inverted-F antenna, a planar inverted F-antenna, a diversity antenna, a micro-strip patch antenna, an electronic identification (EID) antenna, a full-short circuit planar inverted-F antenna (FS-PIFA), a radiation-coupled dual-L antenna (RCDLA), and a double-T slot antenna (DTSA) antenna were introduced.

Here, the planar inverted-E antenna, the micro-strip patch antenna, and a dielectric antenna were an internal antenna according to a related art. That is, the size of the internal antenna is reduced using a dielectric substance or by reducing an electric length thereof through deforming a shape of an antenna element. However, it was difficult to maintain the omni-directional radiation pattern of vertical polarization due to a printed circuit board (PCB) vertically disposed in a mobile phone because the internal antenna was disposed at the PCB only.

Furthermore, a loop antenna having a cap capacitor was introduced to reduce the size thereof. However, it was difficult to maintain high antenna efficiency because the loop antenna having the cap capacitor does not use the resonance characteristics of antenna element.

Meanwhile, since a small antenna physically occupies a small space, the bandwidth of a small antenna is limited in order to maintain good antenna efficiency. Here, the antenna efficiency is a ratio between power radiated from an antenna and power supplied to an antenna.

Therefore, it is limited to use a small antenna for a T-DMB phone, a DVB-H phone, a UHF band terminal, a T-DMB cellular phone, a T-DMB PCS phone, and a DVB-H GSM phone, which provide related services using various frequency bands.

That is, there have been demands for developing a small antenna capable of ultra-wide band transceiving by inducing a plurality of resonant frequencies.

FIG. 1 illustrates a loop antenna in accordance with a related art.

As shown in FIG. 1, the loop antenna according to the related art includes an antenna element 101, a printed circuit board (PCB) 103, a terminal case 105, and a ground plane 107. Here, the antenna element denotes an element having an electric length that decides a resonant frequency. In FIG. 1, an antenna line is used as an antenna element. The PCB 103 includes general circuits such as a RF element connected with an amplifier, a mixer, or an analog-to-digital (AD) converter.

In general, a self-resonance having a maximum valid area against a wavelength is induced when an overall length of the antenna element 101 is about 1 wavelength. Here, the self-resonance denotes a resonance that is induced by the inductance of an inductor and the parasitic capacitance component. The inductor functions as the capacitor by the parasitic component of the inductor at a frequency greater than the self-resonant frequency. Therefore, the inductance component greatly changes in the self-resonance.

However, the loop antenna according to the related art has a similar size of a ¼ wavelength monopole antenna if the self-resonant frequency of 1 wavelength is used as a usable frequency. Thus, the loop antenna according to the related art was not a small antenna. Also, the loop antenna according to the related art has a limitation to control the self-resonant frequency because the length of an antenna element is fixed by a case thereof. For example, a loop antenna is internally fixed at the terminal case 105. If it is required to change the length of the antenna element 101 for controlling the self-resonant frequency, it is also required to change the terminal case 105.

Since a size and a shape of a mobile communication terminal are limited due to the portability, a terminal case is designed and produced at first in consideration of the preference of a consumer and the convenience of a user. Therefore, an antenna must be designed in consideration of the type and shape of a terminal case as well as impedance matching and self-resonant frequency control. That is, an antenna must be capable of controlling a self-resonant frequency regardless of the size of a terminal case.

However, it is difficult to control a resonant frequency without changing the length of a loop antenna because the loop antenna is generally disposed inside a terminal case. Therefore, there have been demands for developing a loop antenna capable of controlling a resonant frequency without changing the overall length of an antenna element by setting a section of an antenna line and changing the antenna line section to control the resonant frequency.

As described above, there have been also demands for developing a loop antenna having high antenna efficiency, having ultra wide bandwidth receiving characteristics by inducing a plurality of resonance frequencies, and having a small size.

DISCLOSURE

Technical Problem

An embodiment of the present invention is directed to providing a small loop antenna having a coaxial cable installed at a predetermined section of an antenna element and for generating a plurality of resonant frequencies by opening or shorting an end of the coaxial cable without changing the overall length of the antenna element while maintaining high antenna efficiency.

Technical Solution

In accordance with an aspect of the present invention, there is provided an antenna including: a first antenna element embodied as a coaxial cable; a second antenna element embodied as a line and connected to one end of the first antenna element in series; a third antenna element embodied as a line, having one end connected to ground plane and the other end connected to the other end of the first antenna element in series; and a power feeding cable for supplying power to the second antenna element.

In accordance with another aspect of the present invention, there is provided an antenna including: a first antenna element embodied as a microstrip line on a board; a second antenna element embodied as an etching line on the board and connected to the first antenna element in series; a third antenna element connected to the first antenna element in series and having one end connected to a ground plane; and a power feeding line for supplying power to the second antenna element.

In accordance with still another aspect of the present invention, there is provided an antenna including: a first antenna element embodied as a microstrip line on a board; a second antenna element embodied as a line on the board; a connector for connecting the first antenna element and the second antenna element in series; and a power feeding cable for supplying power to the second antenna element.

Advantageous Effects

A small loop antenna according to the present invention can be easily installed inside a mobile phone, generate a plurality of resonant frequencies without changing an overall length of an antenna element and having high antenna efficiency.

BEST MODE FOR THE INVENTION

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on a related art may obscure the points of the present invention, the detailed description will not be provided herein. The preferred embodiments of the present invention will be described in detail hereinafter with reference to the attached drawings.

Figure 2:
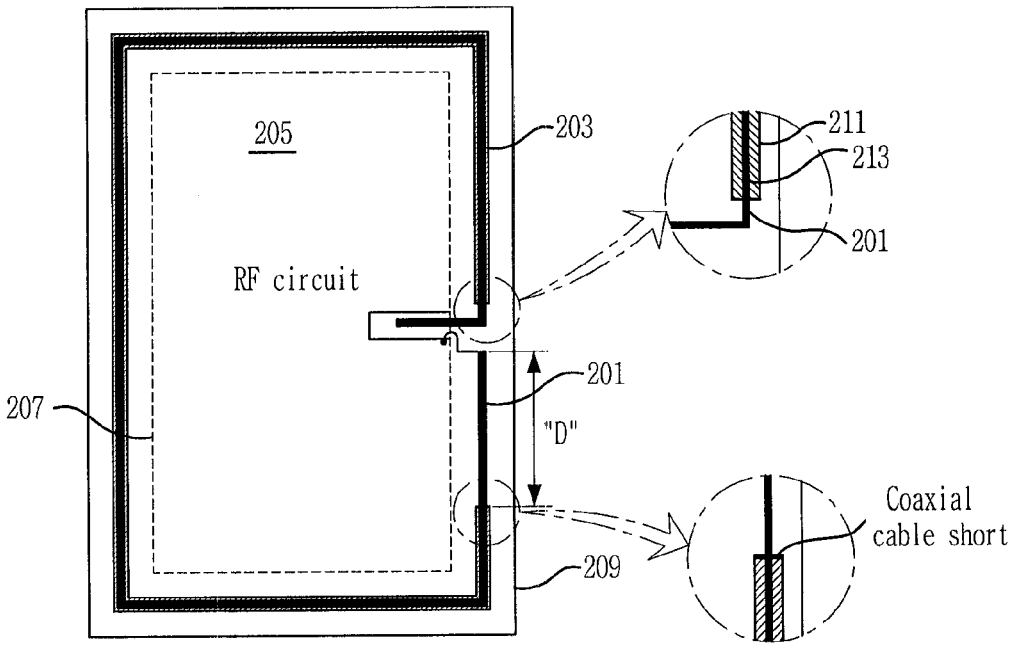
FIG. 2 is a diagram illustrating a loop antenna in accordance with an embodiment of the present invention.

FIG. 2 is a diagram illustrating a loop antenna in accordance with an embodiment of the present invention.

As shown in FIG. 2, the loop antenna according to the present embodiment includes an antenna line 201, a coaxial cable 203, a printed circuit board (PCB) 205, a ground (GND) plane 207, and a terminal case 209. Here, the coaxial cable 203 includes a coaxial cable outer conductor 211 and a coaxial cable inner conductor 213.

The antenna element of the loop antenna according to the present embodiment is disposed between the terminal case 209 and the PCB 205. The PCB 205 includes circuits required for a general antenna having a RF switch.

The antenna element includes an antenna line 201 and a coaxial cable 203. That is, the antenna line 201 connected to a feeder of the PCB circuit 205 is connected to the coaxial cable inner conductor 213 and the end of the coaxial cable 203 is shorted. The coaxial cable outer conductor 211 is connected to the antenna line 201, and the antenna line 201 connected to the coaxial cable outer conductor 211 is connected to the ground plane 207.

Here, the length of the antenna line 201 connected to the end of the shorted coaxial cable 203, that is, a distance to the antenna line 201 connected to the coaxial cable outer conductor 211 is referred as a line replacement length. The influence of the line replacement length to an antenna will be described in detail with reference to FIG. 5.

Figure 1:
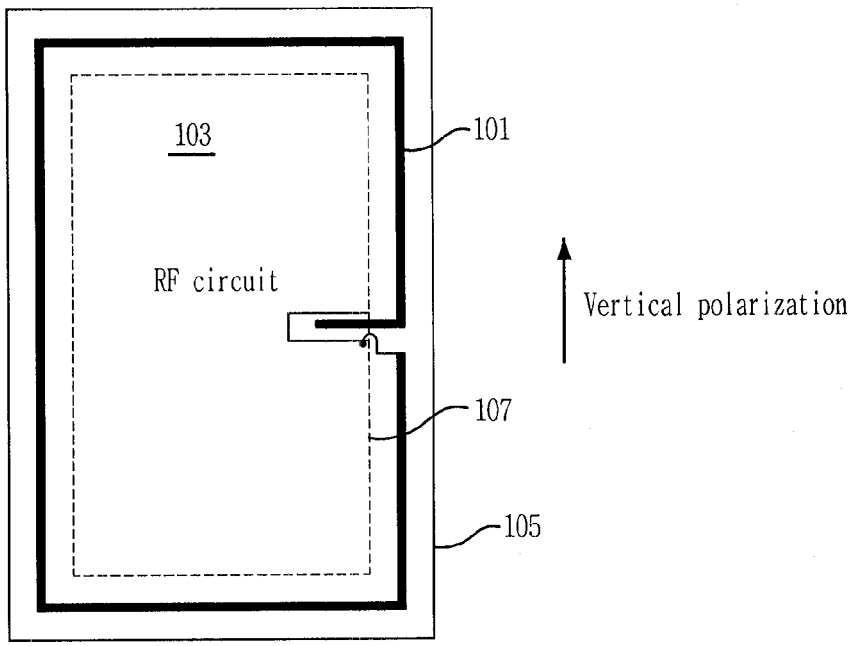
FIG. 1 is a diagram illustrating a loop antenna in accordance with the related art.
Figure 3:
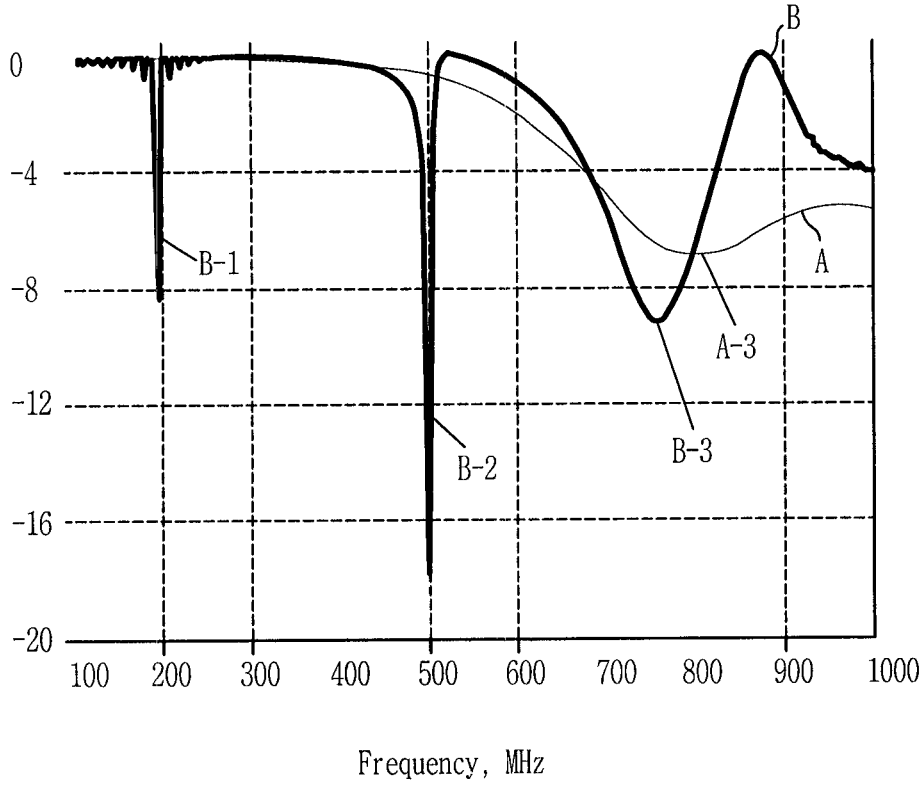
FIG. 3 is a graph illustrating S11 values of the loop antenna shown in FIG. 2 and the loop antenna shown in FIG. 1.

FIG. 3 is a graph illustrating S11 values of the loop antenna shown in FIG. 2 and the loop antenna shown in FIG. 1. Here, it is assumed that the loop area of an antenna element is identical in the both loop antennas as a width of 8 cm and a height of 12 cm. Also, the line replacement length of the loop antenna of FIG. 2 is 0.

The antenna is a disconnected line. The antenna transmits a signal to the outside using predetermined magnetic field energy without reflecting the signal in an omni-directional by inducing one end of the antenna to be resonated in response to a predetermined frequency. That is, an antenna is basically one port device that includes one input port. Therefore, the antenna has only S11 values which denote input reflectivity. The S11 value (dB) becomes minimized at an operating frequency of an antenna. Signal power input to the antenna is maximally radiated to the outside at a frequency with the minimum S11 value. That is, the impedance matching is well induced at where the S11 value becomes minimized.

As shown in FIG. 3, the self-resonant frequency is generated when the length of the antenna element 101 is 1 wavelength A-3 in the loop antenna A according to the related art. That is, the self-resonance is generated at 800 MHz. In general, the antenna has the highest antenna efficiency and superior realized gain at the self-resonant frequency.

However, the loop antenna A according to the related art has very low antenna efficiency at the self-resonant frequency. It is because a feed point is in the center of an 8 cm antenna element side. If an antenna element side of 12 cm includes a feed point, the antenna efficiency will increase more. That is, the loop antenna A according to the related art generates vertical polarization which is parallel to an 8 cm antenna element side.

In case of the loop antenna B according to the present embodiment, the self-resonance is induced when the length of the antenna element is ¼ wavelength (B-1, first resonance) and when the length of the antenna element is ½ wavelength (B-2, second resonance) as well as when the length of the antenna element is 1 wavelength B-3.

The frequencies of the first resonance B-1 and the second resonance B-2 generate a frequency lower than the 1 wavelength resonant frequency A-3 generated from the loop antenna according to the related art.

Since the S11 value is improved at the first resonant frequency B-1 comparing to that A-1 of the loop antenna according to the related art and resonance is induced at a T-DMB frequency band (which ranges from 174 MHz to 216 MHz), it is possible to use the first resonance B-1 frequency, practically. Also, the antenna efficiency is sufficiently high and the impedance matching is well induced at the second resonance B-2 frequency.

Therefore, the loop antenna according to the present embodiment can transmit and receive in an ultrawide band by inducing resonant frequencies of various bands B-1, B-2, and B-3.

Figure 4:
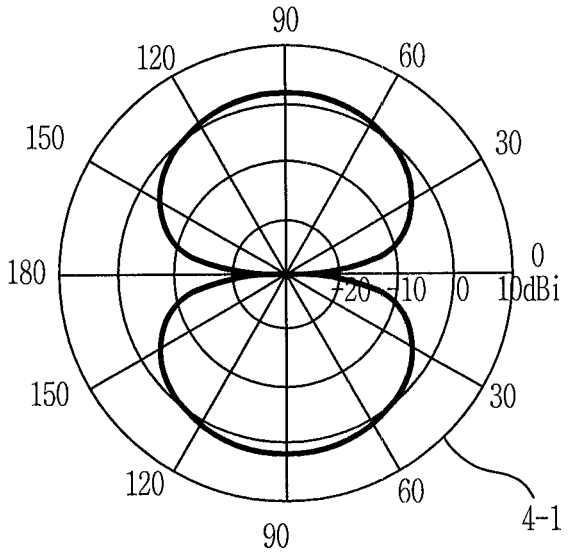
FIG. 4 is a diagram illustrating a power pattern at a second resonant frequency of a loop antenna shown in FIG. 2.
Figure 4:
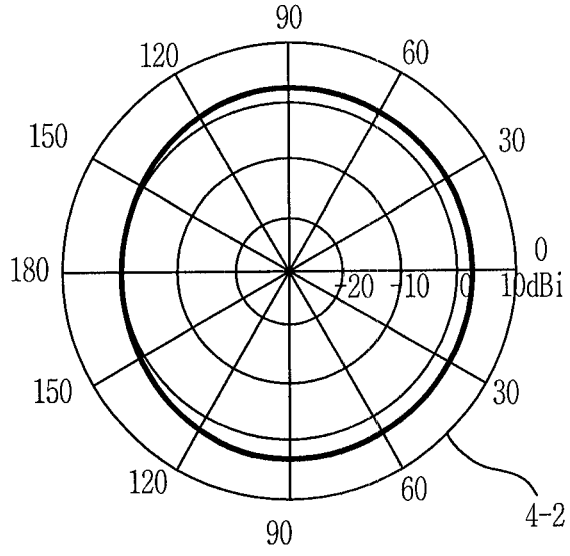

FIG. 4 is a diagram illustrating a power pattern at a second resonant frequency of a loop antenna shown in FIG. 2.

As shown in FIG. 4, a graph 4-1 shows a radiation power pattern according to the variation of elevation angle, and a graph 402 shows a radiation power pattern according to the variation of azimuth angle. Here, the elevation angle denotes a radiation angle radiated vertically from the ground plane. The azimuth angle denotes a radiation angle radiated horizontally from the ground plane.

The graph 4-2 shows that the loop antenna according to the present embodiment maintains omni-directional characteristics like a typical monopole antenna. That is, the loop antenna according to the present embodiment can be used for a terminal to transmit and receive voice, data, and services at anywhere mobile communication is available.

As described above, the loop antenna according to the present embodiment can be used to produce a small antenna because a self-resonant frequency is generated at a low frequency although the loop antenna according to the present embodiment has the same length of an antenna element compared to that of the loop antenna according to the related art.

Figure 5:
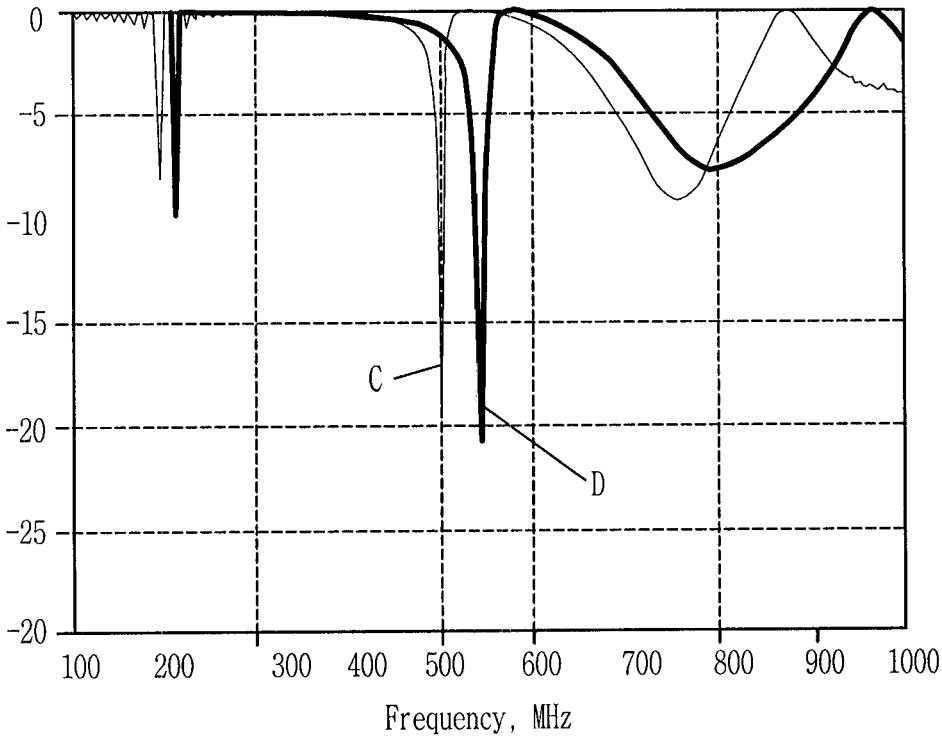
FIG. 5 is a graph showing S11 values according to the variation of a line replacement length of a loop antenna shown in FIG. 2.

FIG. 5 is a graph showing S11 values according to the variation of a line replacement length of a loop antenna shown in FIG. 2.

In FIG. 5, graph C shows S11 values when the line replacement length is about 0 cm and graph D shows S11 values when the line replacement length is about 4 cm.

The resonant frequency changes according to the variation of line replacement length. Thus, it is possible to control a resonant frequency without changing an overall length of the antenna element. Therefore, the loop antenna according to the present embodiment can be easily disposed inside the terminal case and it is an economical solution because the loop antenna according to the present embodiment can be installed without a terminal case.

When the line replacement length is about 4 cm, a resonant frequency is higher than that of a 0 cm line replacement length and close to 1 wavelength resonant frequency. Therefore, the loop antenna according to the present embodiment has the ultrawide band characteristics.

That is, it is possible to control a self-resonant frequency through controlling the line replacement length without changing the overall length of the antenna element.

Figure 6:
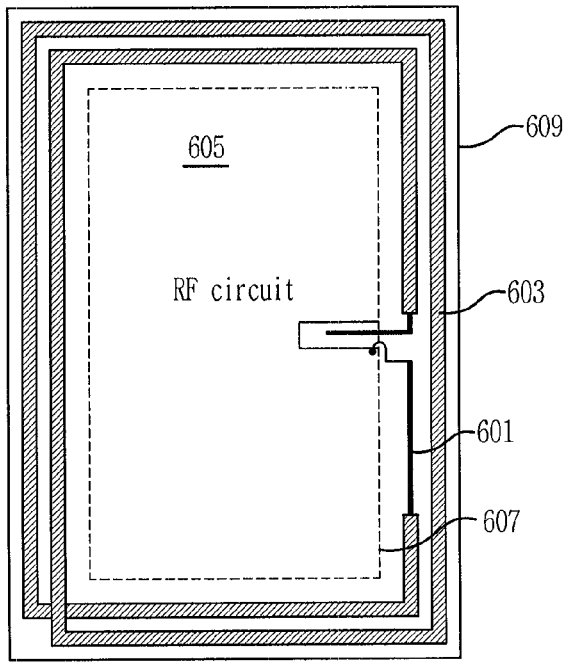
FIG. 6 is a diagram illustrating a loop antenna in accordance with another embodiment of the present invention.

FIG. 6 is a diagram illustrating a loop antenna in accordance with another embodiment of the present invention.

As shown in FIG. 6, where the loop antenna according to another embodiment includes an antenna line 601, a coaxial cable 603, a PCB 605, a ground plane 607, and a terminal case 609.

An antenna element is disposed between the inside of the terminal case 609 and the PCB 605 and the antenna element form two loops along the edge of the terminal case 609. A predetermined section of the antenna line 601 is replaced with the coaxial cable 603.

Since the resonant frequency closely relates to the length of the coaxial cable 603 and the length of the antenna line 601, the overall length of the antenna element increase if the number of loops increases. A resonant frequency can be induced if the overall antenna element length increases. However, if the number of loops increases, antenna radiation efficiency may decrease like the typical loop antenna.

In general, a loop antenna forming one loop is used if it needs to increase the antenna radiation efficiency, and a loop antenna forming more than one loop is used if it needs to produce a small antenna although the antenna radiation efficiency is reduced.

Figure 7:
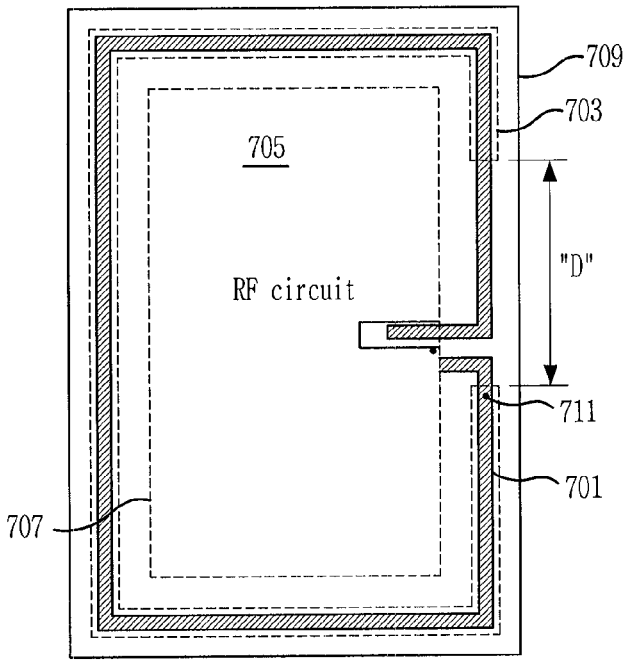
FIG. 7 is a loop antenna in accordance with still another embodiment of the present invention.

FIG. 7 is a loop antenna in accordance with still another embodiment of the present invention.

As shown in FIG. 7, the loop antenna according to the present embodiment includes an antenna line 701, a microstrip line 703, a PCB circuit 705, a ground plane 707, a terminal case 709, and a via 711. The loop antenna according to the present embodiment is disposed at the inside of the PCB circuit 705.

If the coaxial cable 203 of FIG. 2 is replaced with the microstrip line 703, the loop antenna has the same effect of the loop antenna of FIG. 2.

Here, the microstrip line is a transmission line, which operates the same roll of the coaxial cable.

The antenna line 701 is disposed at the front side of the PCB circuit 705 and the microstrip 703 is disposed at the rear side of the PCB circuit 705. Here, the antenna line 701 is connected to a feed point of the inside PCB circuit 705 and the ground plane 707, and the microstrip line 703 overlaps with the antenna line 701. The length of the microstrip line 703 is shorter than the antenna line 701.

The antenna line 701 is connected to the microstrip line 703 and the microstrip line 703 is shorted by installing the via 711 on the ground plane 707 at the rear side of the PCB circuit 705.

Figure 8:
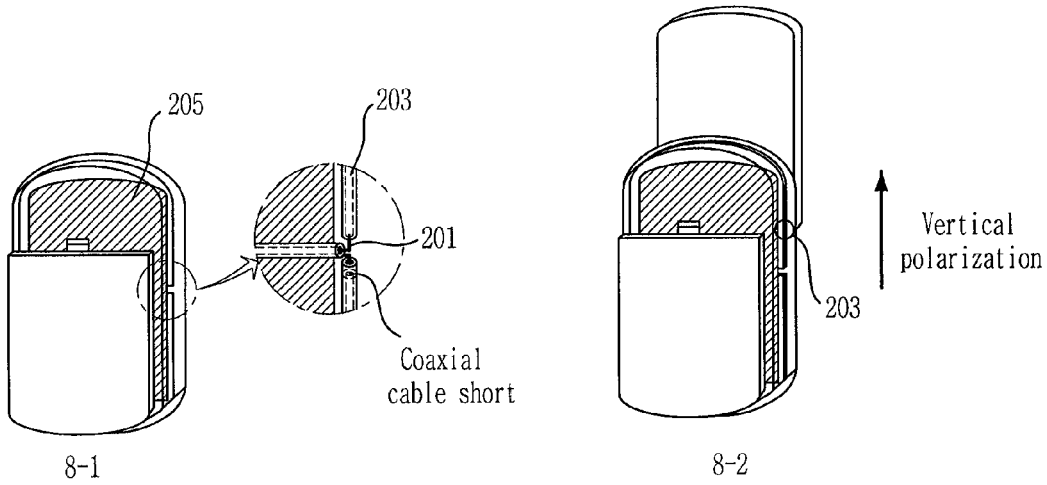
FIG. 8 is a diagram illustrating a flip-type mobile phone and a slim-type mobile phone having a loop antenna in accordance with an embodiment of the present invention.

FIG. 8 is a diagram illustrating a flip-type mobile phone and a slim-type mobile phone having a loop antenna in accordance with an embodiment: of the present invention.

As shown in FIG. 8, the flip-type mobile phone 8-1 includes the loop antenna according to the present embodiment shown in FIG. 2. Also, the slim-type mobile phone 8-2 also includes the loop antenna according to the present embodiment shown in FIG. 2.

That is, the antenna line 201 connected to the feeder of the PCB circuit 205 is connected to the coaxial cable inner conductor 213 and the end of the coaxial cable is shorted. The coaxial cable outer conductor 211 is connected to the antenna line 201 and the antenna line 201 connected to the coaxial cable outer conductor 211 is connected to the ground plane 207.

Here, the slim-type mobile phone 8-2 includes a loop antenna forming a loop along the edge of the terminal case three times. The number of loops may be selected according to a usable frequency.

The feeder of the PCB circuit 205 and the starting part of the antenna line 201 must be disposed at the center of the loop thereof for the mobile phone to have the omni-directional characteristics of the vertical polarization.

Figure 9:
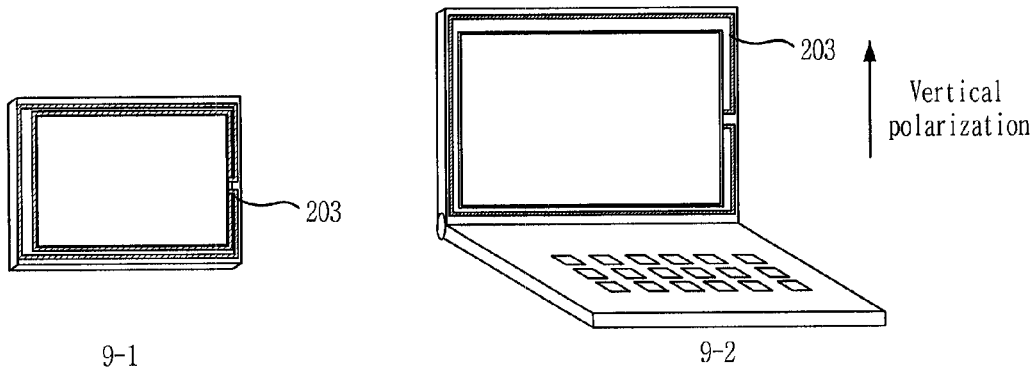
FIG. 9 is diagram illustrating a portable TV and a laptop computer having a loop antenna according to an embodiment of present embodiment.

FIG. 9 is diagram illustrating a portable TV and a laptop computer having a loop antenna according to an embodiment of present embodiment.

Referring to FIG. 1, the portable TV 9-1 internally includes the loop antenna according to the present embodiment shown in FIG. 2. Also, the laptop computer 9-2 internally includes the loop antenna according to the present embodiment shown in FIG. 2.

Like FIG., 8, the feeder of the PCB circuit and the starting part of the antenna line must be disposed at the center of the right side thereof for the portable TV or the laptop computer to have the omnidirectional characteristics of the vertical polarization.

Figure 10:
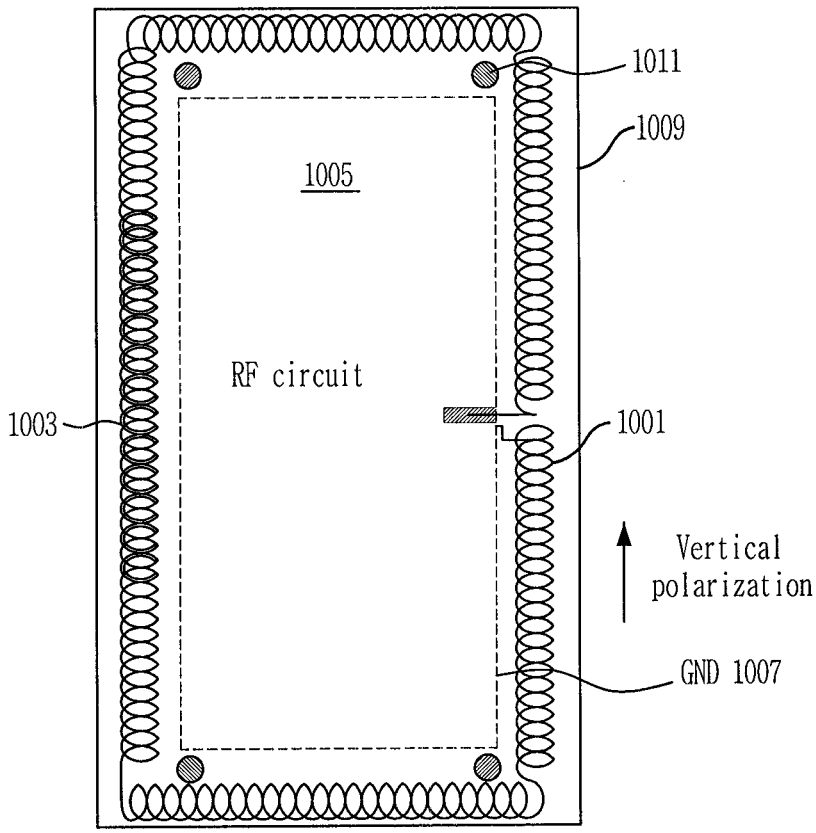
FIG. 10 is a diagram illustrating a spring-type loop antenna in accordance with an embodiment of the present invention.

FIG. 10 illustrates a spring-type loop antenna in accordance with an embodiment of the present invention.

As shown in FIGS. 2 to 9, a loop antenna according to an embodiment can be used without forming a loop of the loop antenna if a high frequency is used, such as DTV-H, cellular phone, RFID and PCS. However, the loop antenna must form a loop along the edge of a terminal case at predetermined times in order to install the loop antenna into a small portable phone when the loop antenna is used to receive a low frequency such as T-DMB and FM broadcasting. If the number of loops increases, a self-resonance may be induced. However, it is difficult to obtain high antenna radiation efficiency like a monopoly antenna or a dipole antenna. If the antenna line or the coaxial cable outer conductor overlaps due to the increment of the loop number, the coupling amount of an adjacent line or a coaxial cable outer conductor influences antenna efficiency due to the current flowing through the antenna line and the coaxial cable outer conductor.

The spring-type loop antenna according to the present embodiment overcomes such problems. In case of the spring-type loop antenna, the length of an antenna element may be longer than a loop antenna forming one loop. Therefore, the spring-type loop antenna generates a self-resonance at a further lower frequency.

Thus, it is possible to manufacture the loop antennas shown in FIGS. 2 to 9 as the spring-type loop antenna. Also, a method for changing a resonant frequency and impedance matching through controlling the length of an antenna element is identically applied to the spring-type loop antenna. Furthermore, a predetermined section of an antenna line may be produced as a spring-type or a coaxial cable section may be produced as the spring-type.

As shown in FIG. 10, the spring-type loop antenna according to the present embodiment includes an antenna line 1001, a coaxial cable 1003, a PCB circuit 1005, a ground (GND) plane 1007, a terminal case 1009, and a terminal case fixing pin 1011. That is, the antenna line 1001 and the coaxial cable 1003 are produced in a spring-type. The antenna element rotates the terminal case 1009 once and is connected to the feeder of the PCB circuit 1005 and the ground plane 1007 through the microstrip line.

The antenna element of the loop antenna according to the present embodiment is disposed between the inside of the terminal case 1009 and the PCB circuit 1005. The terminal case 1009 and the antenna element are fixed by the terminal case fixing pin 1011. The PCB circuit 1005 includes circuits required for a typical antenna including an RF switch.

The antenna element includes an antenna line 1001 and a coaxial cable 1003. That is, the antenna line 1001 connected to the feeder of the PCB circuit 1005 is connected to the coaxial cable inner conductor at a predetermined area, and the end of the coaxial cable 1003 is shorted. The coaxial cable outer conductor is connected to the antenna line 1001 at a predetermined area, and the antenna line 1001 connected to the coaxial cable outer conductor is connected to the ground plane 1007. In FIG. 10, the coaxial cable outer cable is connected to the antenna line 1001 at the shorter end of the coaxial cable 1003.

Therefore, a low band resonant frequency is generated if the overall length of the antenna element is lengthened.

Here, the antenna line 1001 or the coaxial cable 1003 may be coated with a dielectric substance, or a line wrapped with an outer cover or a coaxial cable may be used as the antenna element. In this case, a short problem can be prevented, which is generated when the antenna line 1001 or the coaxial cable 1003 is coiled.

As described above, the spring-type loop antenna according to the longer antenna element length than that of the loop antenna shown in FIG. 2. Thus, the spring-type loop antenna according to the present embodiment can generate a further lower resonant frequency. That is, the spring-type loop antenna according to the present embodiment can be embodied as a Small antenna.

Also, the impedance matching and the self-resonant frequency can be controlled by controlling the location of antenna shorting or coaxial cable shorting.

Figure 11:
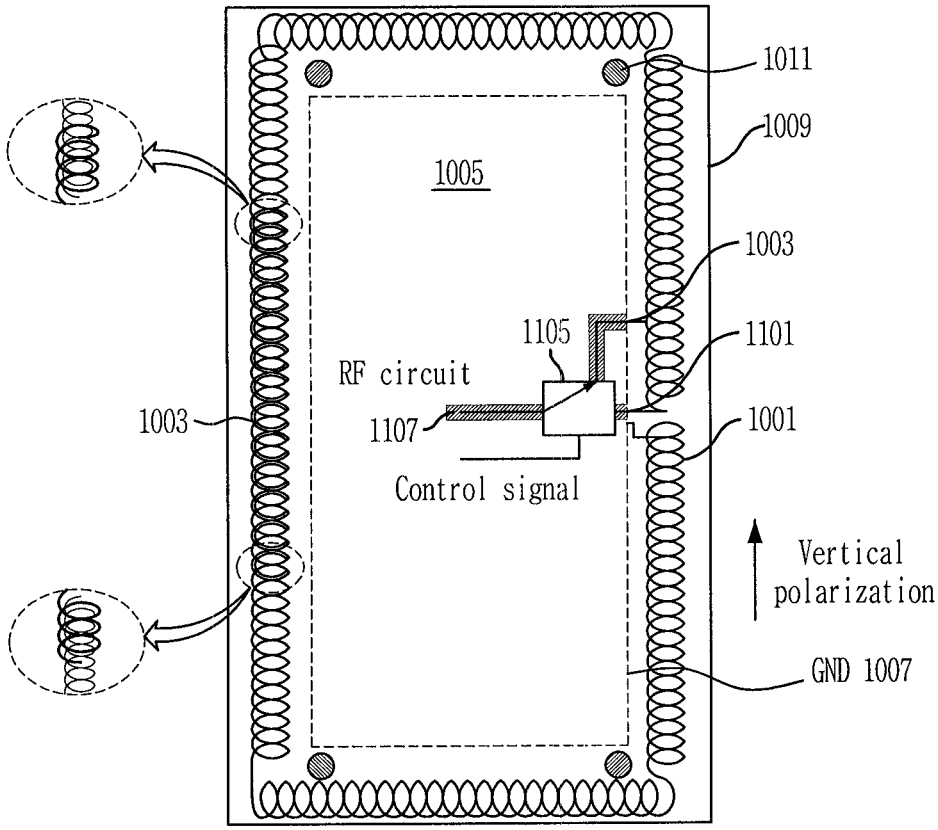
FIG. 11 is a diagram illustrating a spring-type loop antenna having multiple feeders in accordance with an embodiment of the present invention.

FIG. 11 illustrates a spring-type loop antenna having multiple feeders in accordance with an embodiment of the present invention.

An antenna must have wide-band receiving characteristics to receive all service channels for T-DMB, DVB-H, and DTV, which have a plurality of service channels and a narrow channel bandwidth. However, the bandwidth of an antenna is limited as the antenna becomes smaller.

As shown in FIG. 11, the spring-type loop antenna having multiple feeders according to the present embodiment includes an antenna line 1001, a coaxial cable 1003, a PCB circuit 1005, a ground plane (GND) 1007, a terminal case 1009, a terminal case fixing pin 1011, a first feeder 1101, a second feeder 1103, a RF switch 1105, and a circuit output unit 1107. The antenna element is produced in a spring-type. That is, the spring-type loop antenna of FIG. 11 has the same antenna structure of FIG. 10 with a plurality of feeders.

That is, the antenna line 1001 connected to the feeder of the PCB circuit 1005 is connected to the coaxial cable inner conductor at a predetermined area and the end of the coaxial cable 1003 is shorted. The coaxial cable outer conductor is connected to the antenna line 1001 at a predetermined part of the coaxial cable 1003. The antenna line 1001 connected to the coaxial cable outer conductor is connected to the ground plane 1007. In FIG. 11, the coaxial cable outer conductor is connected to the antenna line 1001 at an area where the coaxial cable inner conductor is connected to the antenna line 1001.

The first feeder 1001 and the second feeder 1103 connect the circuit output unit 1107 of the PCB circuit 1005 with the antenna element. Also, the feeder 1001 and the second feeder 1103 are disposed to change the overall length of the antenna element according to each of the feeders, where the overall length is a distance from the feed point to where the antenna is grounded.

The RF switch 1105 selectively connects the circuit output unit 1107 to one of the first feeder 1101 and the second feeder 1103 using a control signal outputted from the PCB circuit 1005. The overall length of the antenna element changes by selectively connecting the circuit output unit 1107 to one of the first and second feeders 1101 and 1103. Therefore, the resonant length of the antenna changes too.

In FIG. 11, the spring-type loop antenna according to the present embodiment includes two feeders 1101 and 1103. However, the number of feeders may vary according to embodiments, for example, three, four, and five.

The circuit output unit 1107 is a feeder. That is, the circuit output unit 1107 supplies power to an antenna element from the PCB circuit 1005 through the feeder 1101 and the second feeder 1103.

Figure 12:
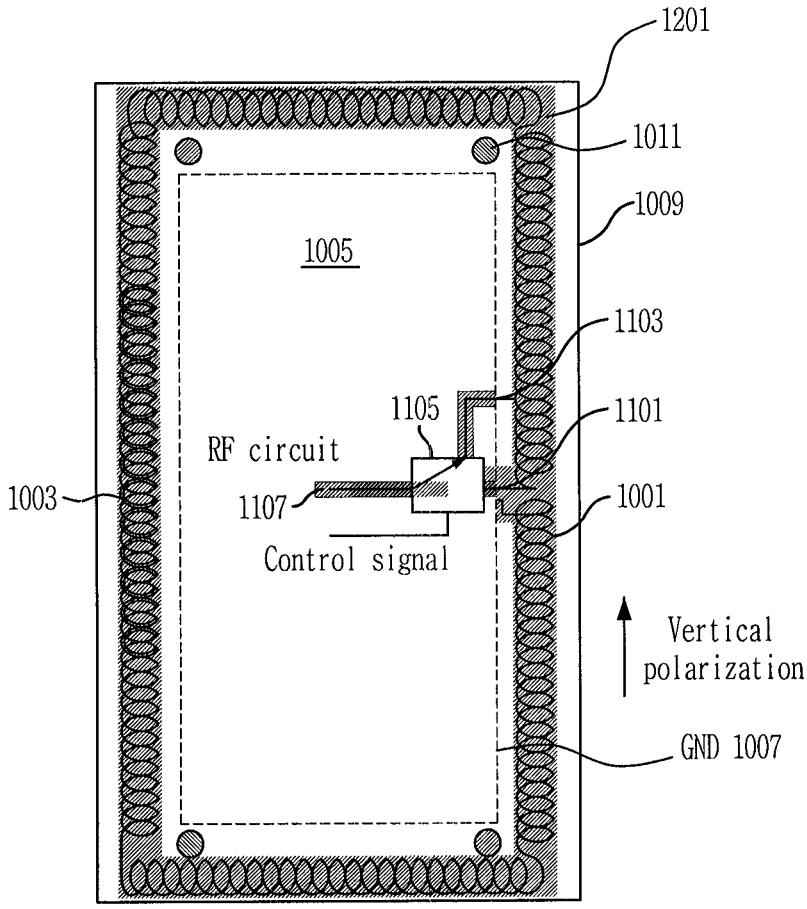
FIG. 12 is a diagram illustrating a short prevention loop antenna in accordance with an embodiment of the present invention.

FIG. 12 is a diagram illustrating a short prevention loop antenna in accordance with an embodiment of the present invention.

As shown in FIG. 12, an elastic dielectric substance 1201, such as rubber, or a bendable dielectric substance 1201, such as Tefron, is disposed between the PCB circuit 1005 and the terminal case 1009, where the antenna element is disposed. That is, the antenna element is disposed inside the dielectric substance 1201. The dielectric substance 1201 includes an antenna line 1101 and a coaxial cable 1003.

By forming the circuit output unit 1107 using a hard dielectric substance such as PVC, the antenna may be easily installed in the terminal and a shorting problem may be prevented from being generated between the antenna element and the terminal case or between the antenna elements.

Figure 13:
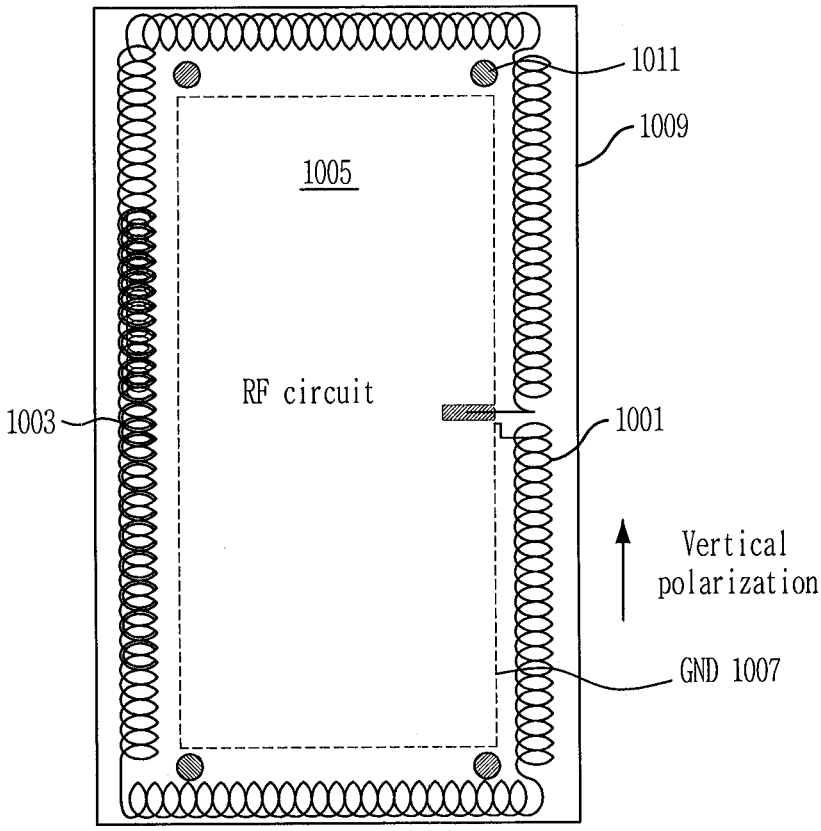
FIG. 13 is a diagram illustrating a coaxial cable overlapped loop antenna in accordance with an embodiment of the present; invention.

FIG. 13 is a diagram illustrating a coaxial cable overlapped loop antenna in accordance with an embodiment of the present invention.

Referring to FIG. 13, the spring-type antenna lien 1001 is disposed inside the spring-type coaxial cable 1003 by coiling the antenna line 1001 with a predetermined radius smaller than that of the coaxial cable 1003. That is, if the spring-type coaxial cable 1003 is disposed at a predetermined section of an antenna element, a predetermined part of the spring-type coaxial cable disposed section includes the antenna line 1001 which is coiled with a smaller radius. Here, at a starting section of overlapping the coaxial cable 1003 and the antenna line 1001, the antenna line 1001 is connected to the coaxial cable inner conductor. At an end section of overlapping the coaxial cable 1003 and the antenna line 1001, the antenna line 1001 is connected to a coaxial cable outer conductor.

Therefore, the overall length of the antenna element is lengthened because the coaxial cable 1003 and the antenna line 1001 are electrically separated. When the terminal case 1009 has a fixed space for installing an antenna, the coaxial cable overlapped loop antenna according to the present embodiment occupies the length of the antenna element further longer. Therefore, the coaxial cable overlapped loop antenna according to the present embodiment can generate a further lower band of a self-resonance frequency.

The spring-type loop antennas shown in FIGS. 10 to 13 can have the omnidirectional characteristics of vertical polarization because a feeder is disposed at the center of the terminal when a 1 wavelength resonance of an antenna element is used like the typical loop antenna.

Figure 14:
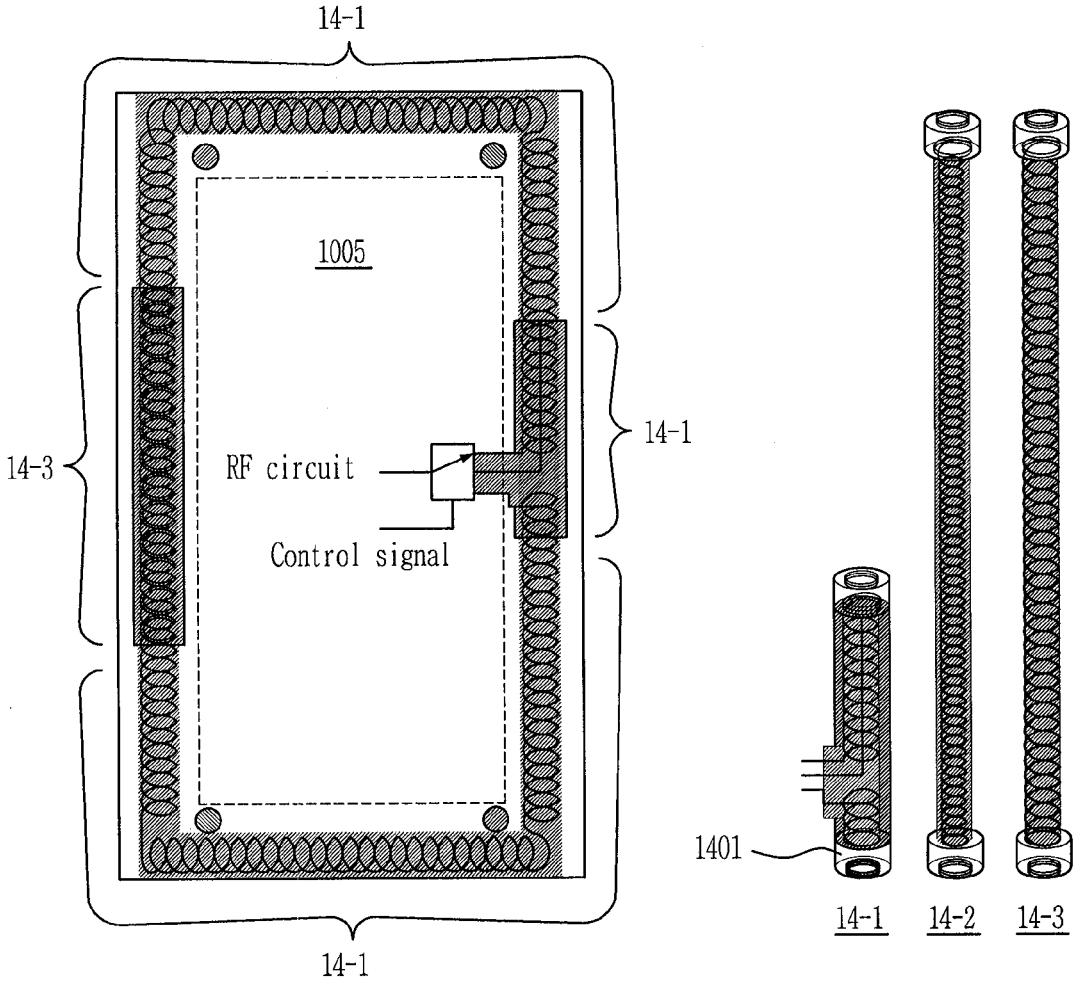
FIG. 14 is a diagram illustrating an assemblable spring-type loop antenna in accordance with an embodiment of the present invention.

FIG. 14 illustrates an assemblable spring-type loop antenna in accordance with an embodiment of the present invention.

As shown in FIG. 14, a terminal includes a first antenna element 14-1, a second antenna element 14-2, a third antenna element 14-3, a PCB circuit 1005, and a ground plane 1007. According to the present embodiment, an easy mountable antenna can be embodied by disposing a loop antenna in an elastic dielectric substance, such as a rubber, while the antenna performance is maintained at a proper level.

The first antenna element 14-1 includes an antenna line 1001 connected to a feeder of a PCB circuit 1005 and the ground plane 1007. The second antenna element 14-2 is an antenna element made of a spring-type antenna line 1001 only. The third antenna element 1403 is an antenna element made of a spring-type coaxial cable 1003 only.

In the loop antenna according to the present embodiment, more than two of the second antenna elements 14-2 are necessary to connect the third antenna element 14-3 to the first antenna element 14-1.

The assemblable antenna according to the present embodiment, which includes three antenna elements 14-1, 14-2, and 14-3, makes possible to manufacture an antenna in various sizes and makes it easy to produce and dispose an antenna.

That is, a plurality of antenna elements 14-1, 14-2, and 14-3 are manufactured by disposing different lengths of antenna lines in different elastic dielectric substances. Then, the both ends of the first antenna element 14-1 connected to the PCB circuit 1005 is connected to two second antenna elements 14-2. The second antenna element 14-2 is connected to the third antenna element 14-3.

In order to connect three antenna elements 14-1, 14-2, and 14-3, conductive connection screws 1401 are connected both ends of each of the antenna elements. That is, three antenna elements 14-1, 14-2, and 14-3 are connected through the conductive connection screws 1401.

Figure 15:
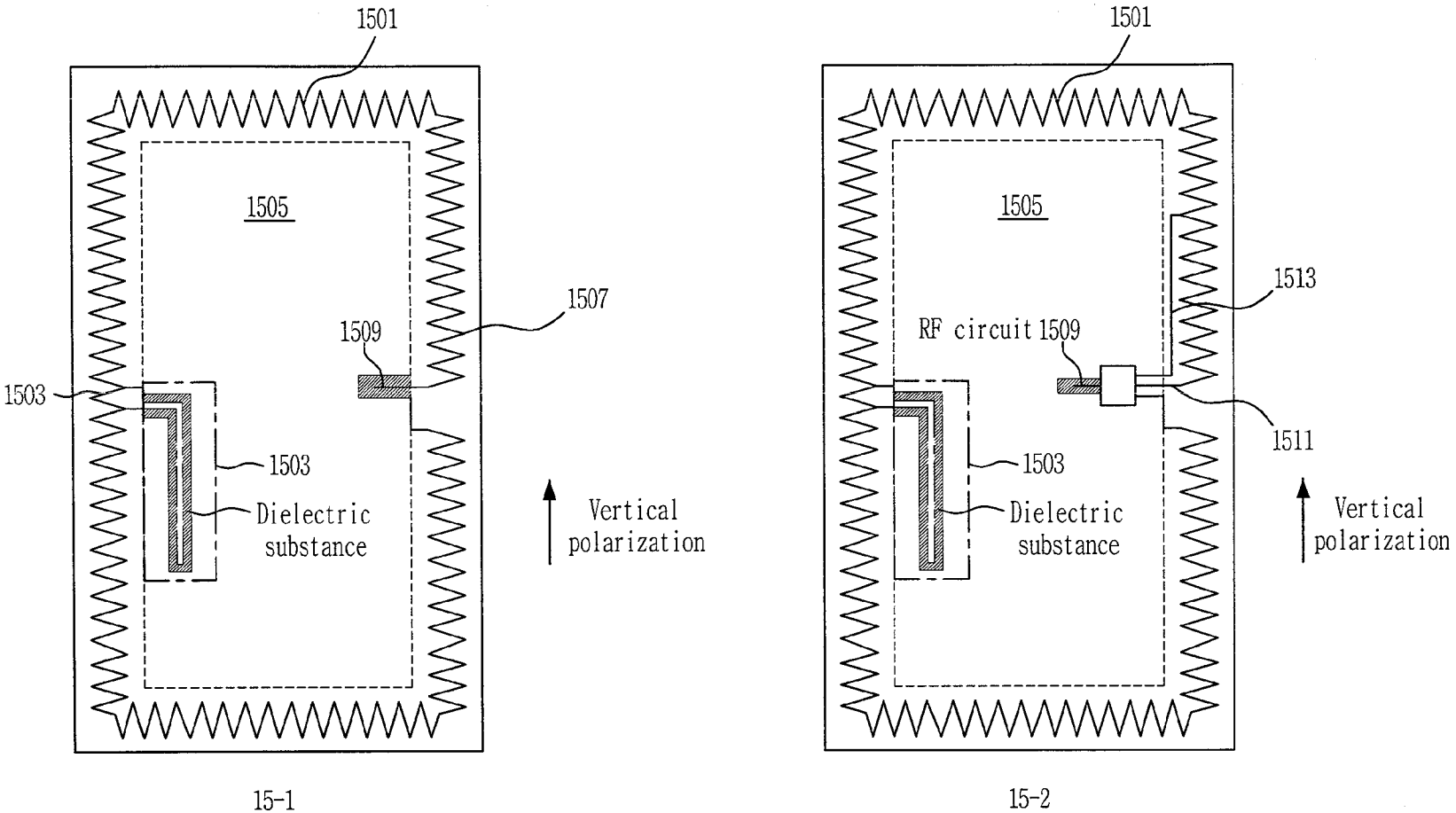
FIG. 15 is a diagram illustrating a PCB loop antenna in accordance with an embodiment of the present invention.

FIG. 15 is a diagram illustrating a PCB loop antenna in accordance with an embodiment of the present invention.

In general, a RF switch is disposed on a PCB circuit, and the power supplied to an antenna can be controlled by automatically switching the RE switch according to channel information. If an antenna includes a plurality of feeders, one of the feed points can be also selected through controlling the RF switch. Therefore, a resonance frequency can be controlled in various ways by changing an overall length of an antenna, which is a distance from a feed point to an end of an antenna.

As shown in FIG. 15, the PCB loop antenna according to the present embodiment includes an etching antenna line 1501, a microstrip line 1503, a PCB 1505, a via 1507, and a power feeding microstrip line 1509. If the PCB loop antenna according to the present embodiment includes a plurality of feed points, the PCB loop antenna further includes a first branch etching antenna line 1511 and a second branch etching antenna line 1513. Here, the via 1507 connects lines of a front side and a read side to provide the same effect of a spring-type line.

In a loop antenna 15-1 having one feed point, the etching antenna line 1501 is disposed by etching the edge area of the PCB 1505 having no ground plane in zigzag fashion. Here, the via 1507 is disposed to provide the same effect of the spring-type antenna line.

The bottom of the microstrip line is completely coated with a GND metal, and a dielectric substance having a predetermined height and a predetermined permittivity is disposed on the GND metal. A signal line, a three-layered conductor, is disposed on the dielectric substance. That is, it is equivalent to an opened coaxial cable after cutting the coaxial cable in half. That GND metal may be equivalent to an outer conductor of a coaxial cable and the signal line may be equivalent to an inner conductor of the coaxial cable.

The etching antenna line 1501 is connected to the power feeding microstrip line 1509 for receiving the power from the PCB circuit. That is, the connection of the etching antenna line 1501 connected to the power feeding microstrip line 1509 and the microstrip line 1503 disposed at the PCB 1505 is equivalent to the connection of the antenna line and the outer conductor of the coaxial cable. Also, the connection of the etching antenna line 1501 connected to the ground plane and the microstrip line 1503 disposed in the PCB 1505 is equivalent to the connection of the antenna line and the inner conductor of a coaxial cable.

Instead of a coaxial cable, the microstrip line 1503 is disposed at an edge of the PCB 1505 having no ground plane and connected to the etching antenna line 1501. One end of the microstrip line 1503 is shorted by connecting it to the PCB 1505. Here, the impedance matching and the self-resonance frequency can be controlled by controlling the overall length of the microstrip line 1503. Here, if the end of the microstrip line 1503 is opened by not connecting it to the PCB 1505, the effects of opening and shorting the end of the microstrip line 1503 are identical.

The shorted microstrip line 1503 is connected to the etching antenna line 1501 and the etching antenna line 1501 is connected to a ground plane.

In a loop antenna 15-2 having two feed points, the PCB 1505 is connected to the power feeding microstrip line 1509, and the power supplied from the power feeding microstrip line 1509 is supplied to one of the first branch etching antenna line 1511 and the second branch etching antenna line 1513 by the control signal. Here, the overall length of the antenna element may change according to each of the first and second branch etching antenna lines 1511 and 1513.

Since the PCB loop antenna according to the present embodiment is manufactured by embodying a monopoly antenna on a PCB circuit, a manufacturing cost thereof is reduced. Also, the PCB loop antenna according to the present embodiment can be produced through mass production. Furthermore, the PCB loop antenna according to the present embodiment can be manufactured conveniently because it can be manufactured through a PCB forming process without an additional antenna manufacturing process.

The PCB loop antenna according to the present embodiment can be used for a RFID) transponder antenna as well as for a mobile terminal and can be used as a small antenna if the PCB loop antenna includes a slim-type impedance matching circuit with a transponder chip.

As described above, the technology of the present invention can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to certain preferred embodiments, it will be apparent to those skilled in the art that various changes and modifications may be made without departing from the scope of the invention as defined in the following claims.

Industrial Applicability

According to the present invention, a small loop antenna having high antenna efficiency and generating a plurality of resonant frequencies can be embodiment.

What is claimed is:

1. An antenna comprising:

a first antenna element embodied as a coaxial cable including an inner conductor and an outer conductor, the first antenna element having a first end and a second end, the inner conductor having a first end at the first end of the first antenna element and a second end at the second end of the first antenna element, the outer conductor having a first end at the first end of the first antenna element and a second end at the second end of the first antenna element, the second end of the inner conductor being shorted to the second end of the outer conductor at the second end of the first antenna element;

a second antenna element embodied as a line and connected to the inner conductor in series at the first end of the first antenna element;

a third antenna element embodied as a line, having one end connected to a ground plane and the other end connected to the outer conductor in series at the second end of the first antenna element; and a power feeding cable for supplying power to the second antenna element.

2. The antenna of claim 1, wherein each of the first antenna element, the second antenna element, and the third antenna element has a predetermined electric length to enable the antenna to have a plurality of resonant frequencies.

3. The antenna of claim 1, wherein the first antenna element, the second antenna element, and the third antenna element, which are connected in series, form a loop at least one time.

4. The antenna of claim 1, wherein the first antenna element, the second antenna element, and the third antenna element are embodied in a spring shape.

5. The antenna of claim 1, further comprising a fourth antenna element having one end connected to a junction of the first antenna element and the second antenna element, disposed to be surrounded by the second antenna element, and having the other end connected to the second antenna element.

6. The antenna of claim 5, further comprising a dielectric substance disposed to surround the first antenna element, the second antenna element, and the third antenna element.

7. The antenna of claim 1, wherein, taken from a plan view, the first, second and third antenna elements collectively form a loop.

8. An antenna comprising:

a first antenna element embodied as a microstrip line at a rear side of a board;

a second antenna element embodied as a line at a front side of the board, wherein the microstrip line, taken from a plan view, overlaps with the second antenna element;

a via on a ground plane at the rear side of the board, the via connecting the microstrip line at the rear side to the second antenna element at the front side in series, the microstrip line being shorted by the via; and a power feeding cable for supplying power to the second antenna element.

9. The antenna of claim 8, wherein each of the first antenna element and the second antenna element has a predetermined electric length to enable the antenna to have a plurality of resonant frequencies.

10. The antenna of claim 8, wherein, taken from a plan view, the second antenna element forms a loop.

11. The antenna of claim 8, wherein the microstrip line, taken from a plan view, continuously overlaps with the second antenna element from one end of the microstrip line to the other end of the microstrip line.

* * * * *